United States Patent [19]

Klein

[11] 4,341,506

[45] Jul. 27, 1982

[54] APPARATUS FOR THE GENERATION OF COMPRESSED AIR

[75] Inventor: Rüdiger Klein, Dorsten, Fed. Rep. of Germany

[73] Assignee: Gutehoffnungshütte Sterkrade A.G., Oberhausen, Fed. Rep. of Germany

[21] Appl. No.: 66,547

[22] Filed: Aug. 14, 1979

[51] Int. Cl.[3] ..... F04B 35/04; F01M 1/00

[52] U.S. Cl. ..... 417/362; 418/DIG. 1; 418/83; 418/84

[58] Field of Search ..... 417/362; 418/DIG. 1, 418/83, 84

[56] References Cited

U.S. PATENT DOCUMENTS

| | | | |
|---|---|---|---|
| 1,439,628 | 12/1922 | Kien | 418/85 |
| 2,361,146 | 10/1944 | Montolius | 418/DIG. 1 |
| 2,634,904 | 4/1953 | Clerc | 418/77 |
| 2,789,756 | 4/1957 | Allen | 417/362 |
| 3,101,890 | 8/1963 | Carlson | 417/362 |
| 3,176,913 | 4/1965 | Sorg et al. | 418/85 |
| 3,291,385 | 12/1966 | Williams et al. | 418/88 |
| 3,480,204 | 11/1969 | Harlin | 418/DIG. 1 |
| 3,542,497 | 11/1970 | Chapius | 418/84 |
| 3,820,923 | 6/1974 | Zweifel | 418/84 |
| 3,825,372 | 7/1974 | Lundberg | 417/321 |
| 3,852,003 | 12/1974 | Adalbert | 418/DIG. 1 |
| 4,063,855 | 12/1977 | Paul | 418/DIG. 1 |
| 4,173,440 | 11/1979 | Libis | 418/DIG. 1 |
| 4,174,196 | 11/1979 | Mori | 418/85 |
| 4,180,986 | 1/1980 | Shaw | 418/84 |
| 4,244,680 | 1/1981 | Ishizuka | 418/DIG. 1 |

FOREIGN PATENT DOCUMENTS

| | | | |
|---|---|---|---|
| 829769 | 12/1951 | Fed. Rep. of Germany | 417/362 |
| 1033840 | 7/1958 | Fed. Rep. of Germany | 417/362 |

*Primary Examiner*—William L. Freeh

*Attorney, Agent, or Firm*—Toren, McGeady & Stanger

[57] ABSTRACT

Apparatus for the generation of compressed air includes a compressor, a motor for driving the compressor, a supply source of liquid lubricant for cooling the compressor, a storage container for the liquid lubricant, devices for separating the lubricant from the compressed air and for cooling the separated lubricant, and devices for controlling and regulating the procedures effected by the apparatus in the generation of the compressed air. The invention is directed toward improvements wherein the storage container is constructed as a pressure vessel for receiving and collecting the lubricant, wherein the compressor, which includes a high-pressure-conducting housing section, is releasably incorporated in a pressure-tight manner in the pressure vessel at least to the extent of the high-pressure-conducting housing section and wherein the motor, the lubricant cooling devices and the control devices are located on the exterior of the pressure vessel so as to be arranged to be essentially adjusted to the contours of the pressure vessel.

4 Claims, 2 Drawing Figures

APPARATUS FOR THE GENERATION OF COMPRESSED AIR

BACKGROUND OF THE INVENTION

The present invention relates generally to apparatus for the generation of compressed air and particularly to apparatus of the type utilizing a motor-driven compressor, cooling lubricant, storage means for the lubricant, means for separating lubricant from the compressed air and for cooling the lubricant and various control and regulating devices.

Prior art devices of the type to which the present invention relates are known, for example, from German Offenlegungsschrift No. 23 02 046. In an arrangement of this type, there is provided a housing which is divided in the longitudinal direction into several sections and which has individual sections which are screwed together. Each section serves to support or receive a functional group or several functional groups of the compressed-air generating plant. Consequently, there is required a plurality of fitting surfaces which must be accurately finished or machined. As a result, the manufacture of such devices becomes cumbersome and increased attention is required from workers or specialists performing the assembly.

Another disadvantage of such prior art devices resides in the fact that the different functional groups are nested into each other, and particularly in the complete integration of the compressor in a central housing section. Accordingly, the housing must be divided at a respective location for maintenance work or repairs so that, for example, the compressor and its line connections will be accessible. Moreover, the compressor housing must be constructed so as to be pressure-tight at least with respect to the high-pressure portion thereof, and special seals must be provided for the bearings on the high-pressure side. Accordingly, there results the inevitable presence of lines or ducts which lead from one housing section to another and which must also be sealed. Despite the fact that different functional groups are nested into each other, there still results a comparatively large axial length which poses a significant equivalent disadvantage both in stationary and non-stationary use.

The invention is therefore directed to the task of providing an improved apparatus of the type described which will not only operate with reduced space requirements, but which will also reduce production expenses and increase operational safety.

SUMMARY OF THE INVENTION

In the structure of the present invention, a container for receiving and collecting lubricant is provided in the form of a pressure vessel into which there is incorporated in pressure-tight, releasable engagement at least the high-pressure-conducting housing section of the compressor means of the apparatus. This arrangement provides a number of advantageous properties and aside from its actual use as a storage container, the pressure vessel also serves as a preliminary filter for the lubricant precipitating from the compressed air. Furthermore, the pressure vessel serves as a buffer element towards the user devices and, simultaneously, fulfills a storage function for equalizing pressure variations. Finally, the pressure vessel has a conveying function for conveying lubricant from the pressure vessel to the compressor. Since the final compression pressure prevailing in the pressure vessel is higher than the pressure at the injection point of the compressor, the differential pressure urges the lubricant into the compressor through the connected cooling, filtering and throttling members.

The pressure-tight incorporation of the high-pressure portion of the compressor into the pressure vessel has the additional advantage that this housing section is subjected to almost the same pressure loads on the inside as on the outside. In spite of a reduced wall thickness, the design of the housing may still be maintained relatively simple. In addition, special sealing members are not required for the bearings at the high-pressure side and at the joint faces of the compressor housing which may be provided at this location. The bearings on the high pressure side are additionally subjected to an automatic splash lubrication since they are not specially enclosed relative to the interior space of the pressure vessel. The functions of the special sealing members which until now have been absolutely necessary at the compressor, and of the pressure-tight construction of the compressor housing can be completely assigned to the pressure vessel which can be of a much simpler design, particularly due to the lack of movable parts.

All sealing members of the pressure vessel for the various line connections including the pressure-tight fastening of the compressor housing are exclusively static sealing members and, therefore, they are relatively simple to control. In the pressure vessel itself compressed air-conducting lines or ducts are no longer provided thereby enhancing the simplicity of the design and increasing operational safety.

In a preferred further development of the fundamental concepts of the invention, the compressor is inserted with its high-pressure-conducting housing section through an opening in the end face of the essentially cylindrical pressure vessel. Such a pressure vessel can be manufactured without significant difficulties by welding together a cylindrical middle portion and end faces having slightly convex curvatures. The pressure vessel can be sealed with respect to static line and supply connections since all connecting flanges can be completely finished before assembly. Insertion of the compressor housing through an opening at the end face and the pressure-tight fastening provided at this location will simplify maintenance and repair work to a significant degree and will additionally facilitate less troublesome sealing of the compressor housing relative to the pressure vessel.

In accordance with the invention, it may be advantageous to provide the housing section of the compressor, through which low pressure fluid is conducted, with an annular collar by means of which the compressor can be attached in an essentially coaxial arrangement relative to the pressure vessel. The collar may be screw-connected to an annular flange inserted in an opening of the pressure vessel and the annular flange is advantageously welded in a pressure-tight manner into this opening. The screw-connected surfaces of the compressor may be formed prior to welding and less troublesome sealing conditions may therefore be achieved.

Another advantageous feature of the invention resides in the fact that the drive motor for the compressor is provided above the pressure vessel and is connected to the compressor through a V-belt drive. As a result, the motor axis is arranged parallel to the drive shaft of the compressor. Preferably, heavy-duty narrow V-belts are used, wherein the required power and speed ranges can be exactly determined by different wheel sets and by different lengths and numbers of belts. Since the compressor is fixedly mounted in the pressure vessel, the adjustment for the respective type of operation is carried out only through the drive motor. For this purpose, the latter is advantageously mounted on a base plate which is rotatably supported in two forked supports. An adjusting screw forms a third support. Consequently, the distance between shafts and the tension in the belts can be exactly adjusted by means of this adjusting screw. Loosening of this adjustment is prevented by means of check nuts.

In accordance with a further advantageous feature of the invention, a fan which is part of the cooling unit for the lubricant is coupled to another power take-off pin of the drive motor. Accordingly, by arrangement of the drive motor and the cooling unit on the pressure vessel there results a substantial reduction of the installation area required for the entire plant. As a result, the number of installation and operational possibilities are significantly increased. A balancing of oscillations is achieved through the entire unit by means of rubber elements which space the pressure vessel relative to the respective installation surface.

Finally, the invention further provides that there be located at the end face of the pressure vessel opposite the compressor, the devices for controlling or regulating the compression procedure. As a result, these devices, which preferably are arranged in the control cabinet, can be joined closely to the pressure vessel so that the installation area required for the entire unit is not larger than, at most, twice the area of a longitudinal section through the pressure vessel.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE PREFERRED EMBODIMENT

Figure 1:
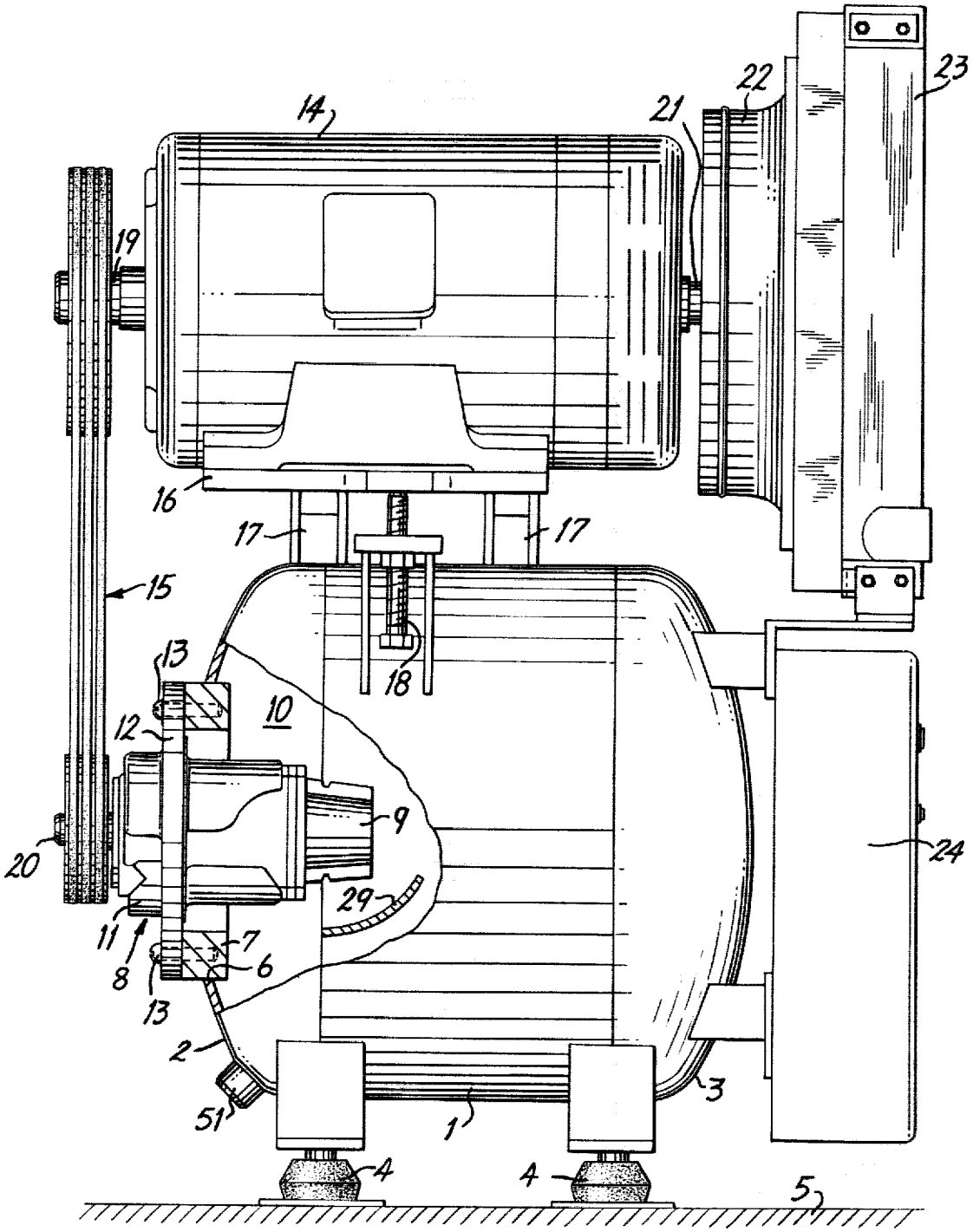
FIG. 1 is a schematic, partial sectional view of a screw compressor unit with oil injection cooling.

Apparatus in accordance with the invention for the generation of compressed air shown in FIG. 1 comprises a pressure vessel 1 which is cylindrical, as viewed along a cross-section thereof, and has end face 2,3 with slightly convex curvatures. The pressure vessel 1 is spaced relative to an installation surface 5 by means of rubber elements 4. The installation surface may be part of a stationary structure or of a non-stationary chassis.

The end face 2 of the pressure vessel 1 has an opening 6 into which there is welded in a pressure-tight manner a previously finished annular flange 7. The annular flange serves to fasten a screw compressor 8 whose housing section 9 conducting high pressure fluid is arranged in the interior space 10 of the pressure vessel 1. An annular collar 12 for fastening the compressor housing to the annular flange 7 is provided on the low pressure-conducting housing section 11 of the compressor 8. Fastening is effected by screws 13 which are arranged on the periphery of the annular collar 7 and are essentially distributed with an equal spacing. The longitudinal axis of the screw compressor 8 is located essentially on the longitudinal axis of the pressure vessel 1.

The screw compressor 8 is driven by an electromotor 14 which is arranged on top of the pressure vessel 1 with a narrow V-belt drive 15 being intermediately arranged therebetween. The electromotor 14 is mounted on a base plate 16 which is rotatably supported in two forked supports 17. An adjusting screw 18 forms a third point of support. A power take-off pin 19 of the electromotor 14 extends parallel to a drive shaft 20 of the screw compressor 8.

A second power take-off pin 21 of the electromotor 14 is coupled to a fan 22 (see also FIG. 2) of an oil cooler 23. The oil-cooler 23 is also supported on the pressure vessel 1. A control cabinet 24 which receives and houses control and regulating devices is located on the end face 3 of the pressure vessel opposite the screw compressor 8.

Connection lines have been omitted from FIG. 1 in order to ensure clarity of illustration.

Figure 2:
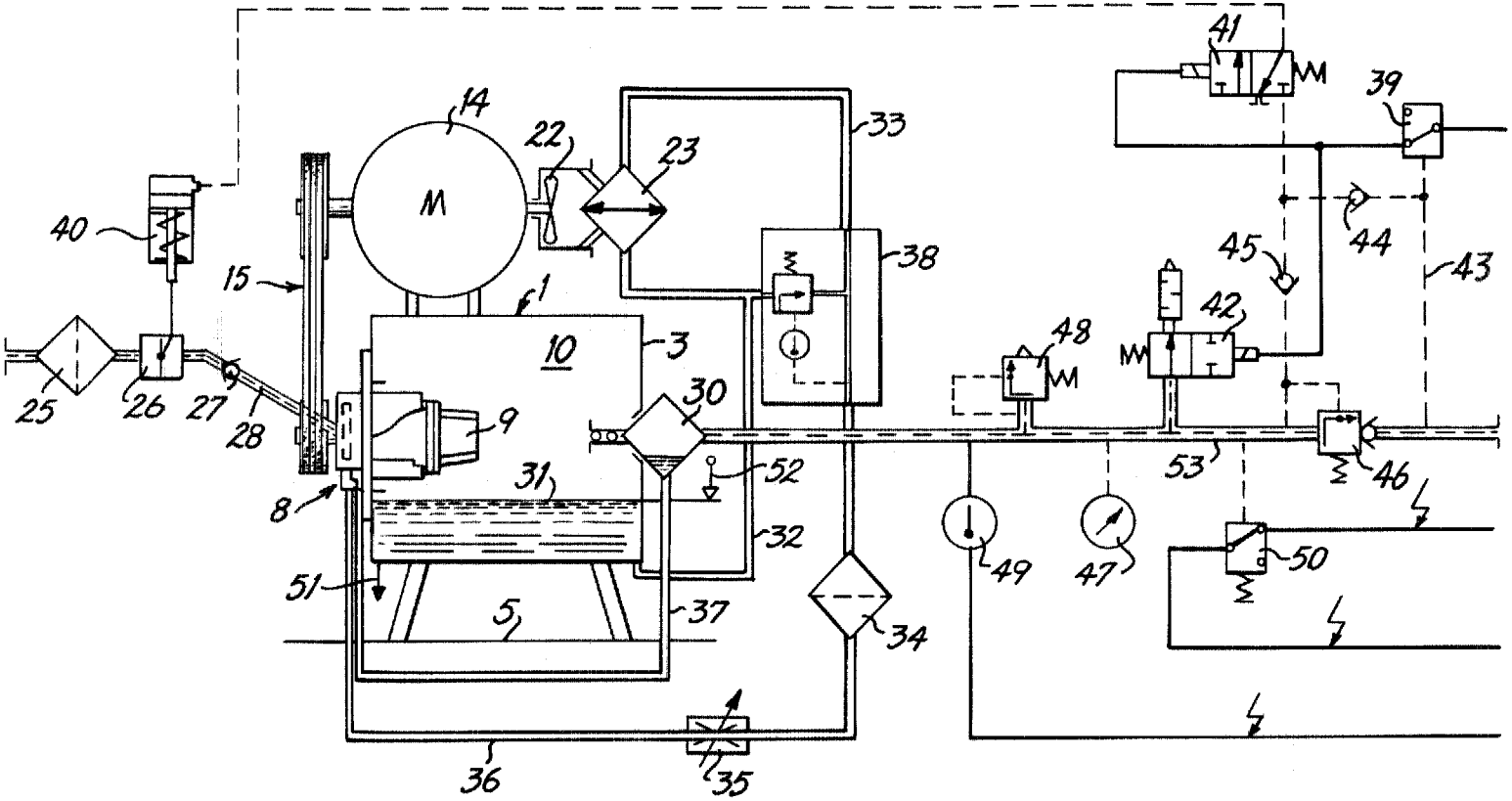
FIG. 2 is a schematic flow diagram of a system including the unit shown in FIG. 1.

As can be seen from the flow diagram according to FIG. 2, air is taken in through a filter element 25 and is conveyed through an adjustable intake throttle valve 26 and an intake check valve 27 in the intake line 28 into the screw compressor 8. The check valve 27 in the intake line 28 prevents the compressed air in the pressure vessel 1 from being released backwardly through the compressor when the unit is not operational. The valve is dimensioned in such a way that the entire quantity of intake air can pass therethrough without significant losses.

During operation of the unit, a large amount of oil is ejected into the compressor 8 during the compression procedure. The function of the oil is to remove a large portion of the compression heat, to lubricate the sides of the sectional members and to seal the gap between the rotors and the housing.

The air-oil mixture flowing out of a high-pressure region of the screw compressor 8 defined by the housing 9 is conveyed directly into the interior space 10 of the pressure vessel 1 and a large portion of the oil precipitates in this space. This procedure is enhanced by baffle or guide surfaces 29, one of these surfaces being shown in FIG. 1. Finally, a fine oil filter or separator 30 mounted in the end face 3 of the pressure vessel divests the mixture almost completely of its oil content.

Since the final compression pressure prevailing in the pressure vessel 1 is always higher than the pressure at the injection point of the screw compressor 8, no pump is necessary for injecting oil required for compression. Instead, the differential pressure forces the oil 31 into the screw compressor from the pressure vessel through the line 32, the oil cooler 23, the line 33, an oil filter 34 and an adjustable throttle 35 in the line 36. The oil collecting in the fine oil separator 30 is also conveyed to the screw conveyor through another line 37.

The illustration of FIG. 2 shows that the oil cycle additionally includes an oil mixing valve 38. The thermostatically controlled oil mixing valve is arranged in the line 33 between the oil cooler 23 and the oil filter 34. This valve operates to heat the oil which is still cold at start-up to room temperature as quickly as possible.

Control of full-load and no-load operation is effected by means of a delivery pressure monitor 39 through the adjustable intake throttle valve 26 with operating cylinder 40 and through electromagnetic valves 41,42. Two check valves 44,45 arranged in the control cycle 43 facilitate a quick reaction of the control mechanism at existing network pressure. In other words, the check valves in the control cycle 43 facilitate the removal of control pressure from the compressor system as well as from the user network. The system which has the higher pressure prevents removal from the other system. In this manner, the compressor 8 can change-over more quickly into the no-load operation at existing network pressure, since the control cylinder 40 is now not only charged after the pressure vessel 1 has been filled (to the set pressure of a minimum pressure valve 46).

The final pressure of the unit is regulated through a pressure gauge 47. An undue increase of the pressure is prevented by a safety valve 48. When the final compression temperature is too high, the unit is safely shut down through a thermometer with remote contact 49.

A second pressure monitor 50 which is arranged directly on the pressure vessel 1 prevents start-up of the unit when the vessel pressure is too high. The pressure vessel 1 is provided with an oil drain 51 and there is additionally arranged on the pressure vessel an oil level indicator 52 for checking the oil level.

As shown schematically in FIG. 2, control elements such as the elements 34, 38 and 41-50 may be housed within the control cabinet 24, in accordance with a preferred embodiment of the invention.

The compressed air emerging from the fine oil separator 30 is almost oil-free and reaches the user system through the minimum pressure valve 46 arranged in the service line 53.

While a specific embodiment of the invention has been shown and described in detail to illustrate the application of the inventive principles, it will be understood that the invention may be embodied otherwise without departing from such principles.

What is claimed is:

1. In apparatus for the generation of compressed air including compressor means, motor means for driving said compressor means, supply means providing liquid lubricant for cooling said compressor means, storage container means for said liquid lubricant, means for separating said lubricant from compressed air, means for cooling said separated lubricant the control means for controlling and regulating the operating parameters of said apparatus in generating said compressed air, the improvements which comprise: that said storage container means is constructed as a pressure vessel for receiving and collecting said lubricant; that said compressor means includes a high-pressure-conducting housing section and is built into said pressure vessel in a pressure-tight manner at least to the extend of said high-pressure-conducting housing section, with said compressor means comprising air intake means through which air is supplied to said pressure vessel; and that said motor means, said lubricant cooling means and said control means are located on the exterior of said pressure vessel and mounted in proximity thereto; said motor means being mounted on the top of said pressure vessel and being connected to said compressor means through a V-belt drive mechanism; said motor means including a first power take off pin connected with said V-belt drive and a second power take off pin coupled to a fan which is operably arranged as part of said means for cooling said separated lubricant.

2. Apparatus according to claim 1 wherein said pressure vessel is formed with an essentially cylindrical configuration having an opening defined in an end face thereof and wherein said compressor means is inserted with said high-pressure-conducting housing section through said opening in said pressure vessel.

3. Apparatus according to claim 2 wherein said compressor means includes a low-pressure-conducting housing section having an annular collar, wherein said pressure vessel includes an annular flange which is inserted into said opening, and wherein said low-pressure-conducting housing section of said compressor is screw-connected through said annular collar with said annular flange in an arrangement essentially coaxial relative to said pressure vessel.

4. Apparatus according to claim 1 wherein said compressor means comprise a screw-type compressor.

* * * * *